US007040745B2

(12) United States Patent
Kent

(10) Patent No.: US 7,040,745 B2
(45) Date of Patent: May 9, 2006

(54) RECIRCULATING INKJET PRINTING SYSTEM

(75) Inventor: Blair M Kent, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 332 days.

(21) Appl. No.: 10/285,251

(22) Filed: Oct. 31, 2002

(65) Prior Publication Data

US 2004/0085416 A1 May 6, 2004

(51) Int. Cl.
*B41J 2/18* (2006.01)

(52) U.S. Cl. ..... 347/89

(58) Field of Classification Search ..... 347/7, 347/89, 92, 93, 84–86, 87, 28
See application file for complete search history.

(56) References Cited

U.S. PATENT DOCUMENTS 4,190,846 A * 2/1980 Yamamoto et al. ..... 347/7
4,320,407 A 3/1982 Goldis et al.
4,346,388 A 8/1982 Wiley
4,658,268 A 4/1987 Needham
4,968,998 A 11/1990 Allen
5,017,941 A 5/1991 Drake
5,040,002 A * 8/1991 Pollacek et al. ..... 347/87
5,455,606 A 10/1995 Keeling et al.
5,505,339 A 4/1996 Cowger et al.
5,818,485 A 10/1998 Rezanka
5,886,718 A 3/1999 Johnson et al.
5,923,353 A * 7/1999 Boyd et al. ..... 347/85
5,936,650 A * 8/1999 Ouchida et al. ..... 347/89
5,980,028 A * 11/1999 Seccombe ..... 347/85
5,988,802 A 11/1999 Pawlowski et al.
6,116,727 A 9/2000 Hagiwara
6,168,268 B1 1/2001 Sugiyama
6,290,323 B1 * 9/2001 Sharma et al. ..... 347/28
6,312,113 B1 11/2001 Murad
6,371,607 B1 4/2002 Wouters et al.
6,478,415 B1 * 11/2002 Barinaga et al. ..... 347/85

FOREIGN PATENT DOCUMENTS

EP 1 359 026 A1 11/2003

OTHER PUBLICATIONS

British Search Report for Application No. GB0325178.2, dated Oct. 12, 2004, 2 pages.

* cited by examiner

*Primary Examiner*—K. Feggins

(57) ABSTRACT

In a recirculating inkjet print recording method and system, ink is stored at an ink supply. Fluid, including ink, is carried from the ink supply to a reservoir. Ink received from the reservoir is recorded onto a medium. Fluid, including ink and air, is carried from the reservoir to the ink supply. A proportion of ink in the fluid carried from the reservoir to the ink supply self-adjusts to prevent overfilling the reservoir.

52 Claims, 5 Drawing Sheets

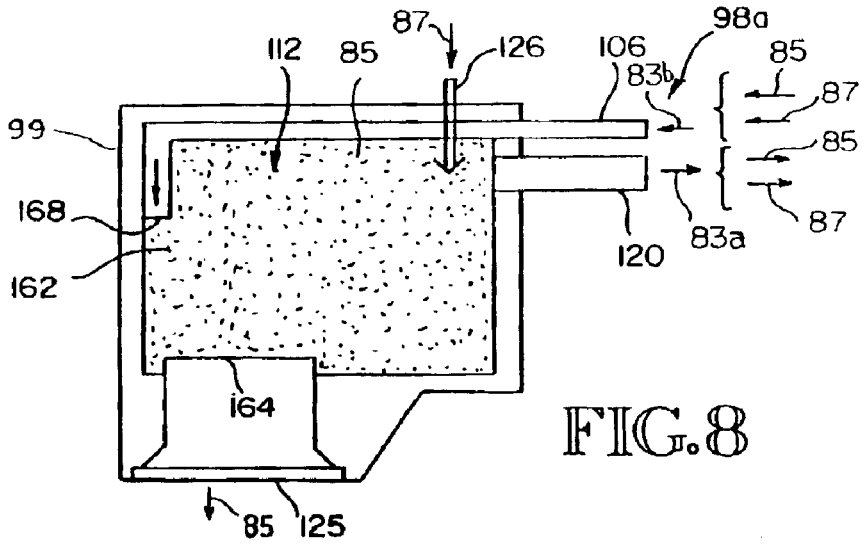
FIG. 8
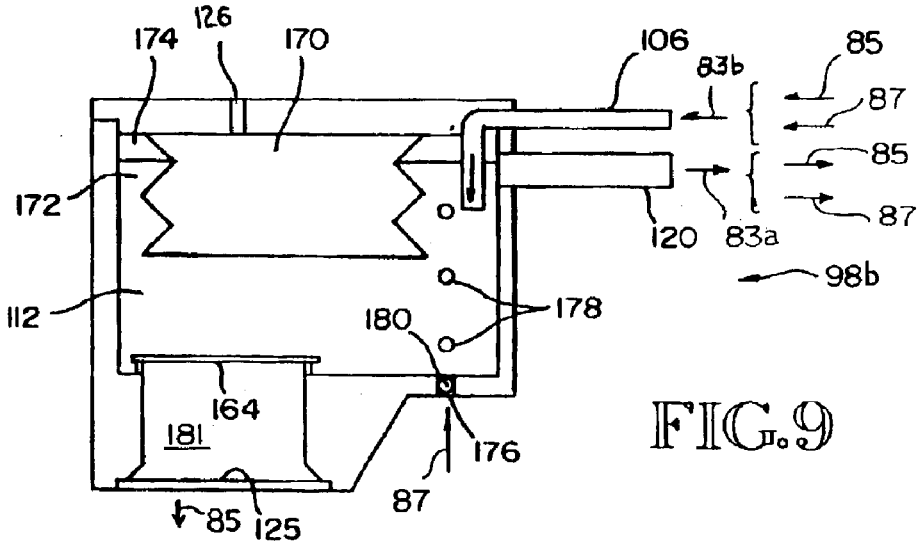
FIG. 9
FIG. 10
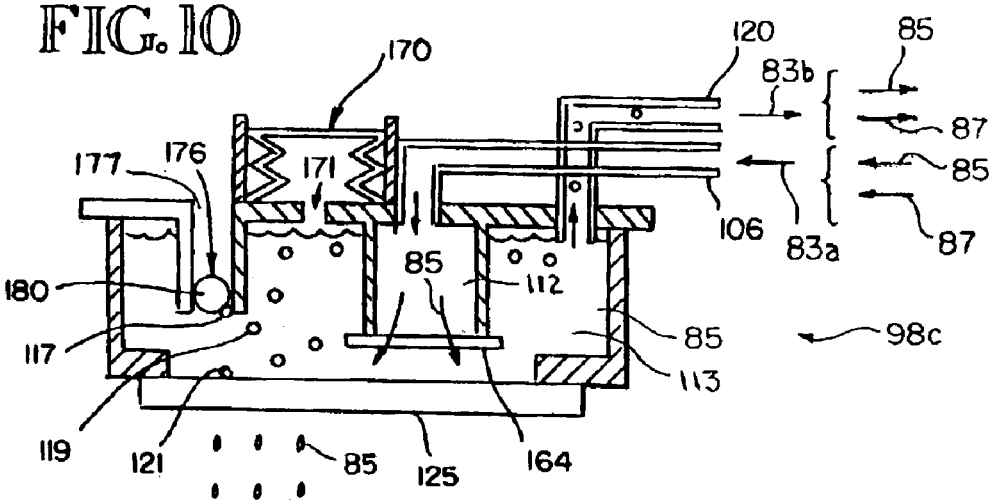

RECIRCULATING INKJET PRINTING SYSTEM

BACKGROUND OF THE INVENTION

An inkjet printing mechanism is a type of non-impact printing device which forms characters, symbols, graphics or other images by controllably spraying drops of ink. The mechanism includes a cartridge, often called a "pen," which houses a printhead. The printhead has very small nozzles through which the ink drops are ejected. To print an image the pen is propelled back and forth across a media sheet, while the ink drops are ejected from the printhead in a controlled pattern.

Inkjet printing mechanisms may be employed in a variety of devices, such as printers, plotters, scanners, facsimile machines, copiers, and the like. There are various forms of inkjet printheads, known to those skilled in the art, including, for example, thermal inkjet printheads and piezoelectric printheads. In a thermal inkjet printing system, ink flows along ink channels from a reservoir into an array of vaporization chambers. Associated with each chamber is a heating element and a nozzle. A respective heating element is energized to heat ink contained within the corresponding chamber. The corresponding nozzle forms an ejection outlet for the heated ink. As the pen moves across the media sheet, the heating elements are selectively energized causing ink drops to be expelled in a controlled pattern. The ink drops dry on the media sheet shortly after deposition to form a desired image (e.g., text, chart, graphic or other image).

An off-axis ink delivery system includes a primary supply of ink stored off the moving carriage axis. In a "take-a-sip" off-axis ink supply system, the carriage moves into a service station where a connection between the cartridge and the off-axis ink supply is established. The cartridge then is refilled.

SUMMARY OF THE INVENTION

In a recirculating inkjet print recording method and system, ink is stored at an ink supply. Fluid, including ink, is carried from the ink supply to a reservoir. Ink received from the reservoir is recorded onto a medium. Fluid, including ink and air, is carried from the reservoir to the ink supply. A proportion of ink in the fluid carried from the reservoir to the ink supply self-adjusts to prevent overfilling the reservoir.

BRIEF DESCRIPTION OF THE DRAWINGS

FIG. 8 is a plane view of an embodiment of an inkjet pen having a porous media within the local reservoir;

FIG. 9 is a plane view of an embodiment of an inkjet pen having an accumulator;

FIG. 10 is a plane view of an embodiment of another inkjet pen having an accumulator;

DETAILED DESCRIPTION OF A PREFERRED EMBODIMENT

Figure 1:
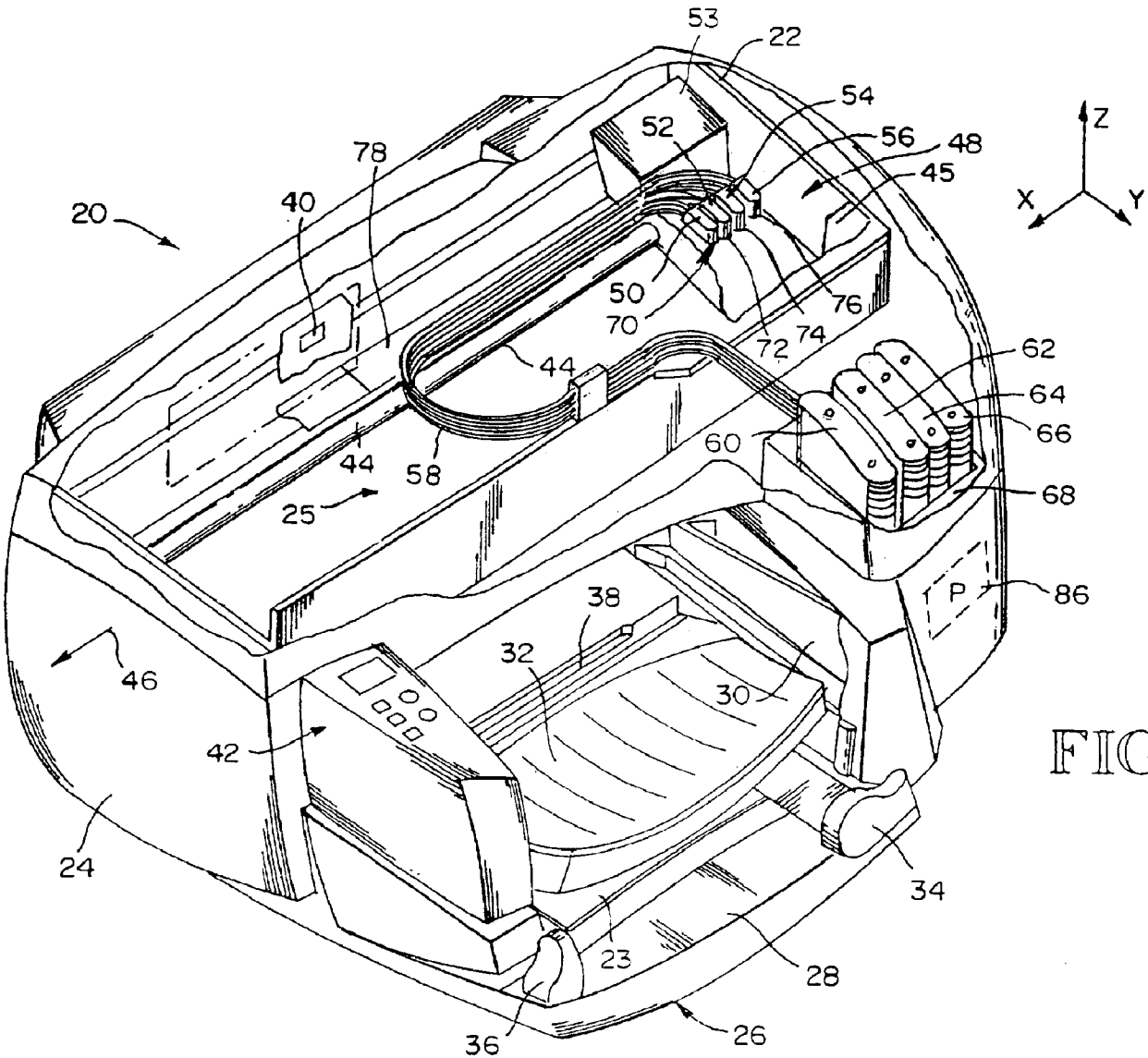
FIG. 1 is a perspective view of one embodiment of an inkjet printing mechanism, here, an inkjet printer, including a media handling system.

FIG. 1 illustrates an inkjet printing system, here shown as an inkjet printer 20, constructed in accordance with an embodiment of the present invention. Such system may be used for printing business reports, printing correspondence, and performing desktop publishing, and the like, in an industrial, office, home or other environment. Some of the printing systems that may embody the present invention include portable printing units, copiers, video printers, and facsimile machines, to name a few, as well as various combination devices, such as a combination facsimile/printer. For convenience the concepts of the present invention are illustrated in the environment of an inkjet printer 20.

The inkjet printer 20 includes a frame or chassis 22 surrounded by a housing, casing or enclosure 24, such as of a plastic material. Sheets of print media 23 are fed through a print-zone 25 by a media handling system 26. The print media 23 may be any type of suitable sheet material, supplied in individual sheets or fed from a roll, such as paper, card-stock, transparencies, photographic paper, fabric, mylar, and the like, but for convenience, the illustrated embodiment is described using a media sheet of paper as the print medium. The media handling system 26 has a feed tray 28 for storing media sheets before printing. A series of drive rollers driven by a stepper motor and drive gear assembly may be used to move the media sheet from the input supply tray 28, through the print-zone 25, and after printing, onto a pair of extended output drying wing members 30, shown in a retracted or rest position in FIG. 1. The wings 30 momentarily hold a newly printed sheet above any previously printed sheets still drying in an output tray portion 32. The wings 30 then retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller 40, which may be embodied by a microprocessor, that receives instructions from a host device, such as a computer (not shown). The printer controller 40 may also operate in response to user inputs provided through a key pad 42 located on the exterior of the casing 24. A monitor (not shown) coupled to the computer host may be used to display visual information to an operator, such as the printer status or a particular program being run on the host computer.

A carriage guide rod 44 is supported by the chassis 22 to slidably support an off-axis inkjet pen carriage system 45 for travel back and forth across the print-zone 25 along a scanning axis 46. The carriage 45 is also propelled along guide rod 44 into a servicing region, as indicated generally by arrow 48, located within the interior of the housing 24. A carriage drive gear and DC (direct current) motor assembly (not shown) may be coupled to drive an endless belt (not shown), which may be secured to the carriage 45. Control signals from the printer controller 40 signal the DC motor to incrementally advance the carriage 45 along guide rod 44. To provide carriage positional feedback information to printer controller 40, an encoder strip (not shown) may extend along the length of the print-zone 25 and over the service station area 48, with an optical encoder reader 53 being mounted on the back surface of printhead carriage 45 to read positional information provided by the encoder strip.

Still referring to FIG. 1, while in the print-zone 25, the media sheet 23 receives ink from one or more inkjet cartridges, such as a black ink cartridge 50 and three monochrome color ink cartridges 52, 54 and 56, shown schematically in FIG. 1. The cartridges 50–56 are also often called "pens" by those in the art. The black ink pen 50 may contain a pigment based ink, while the color pens 52–56 each may contain a dye-based ink of the colors cyan, magenta and yellow, respectively. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system. In an "off-axis" ink delivery system, the main ink supply is stationary and located remote from the print-zone scanning axis. Systems where the main ink supply is stored locally within the pen are referred to as having an "on-axis" ink delivery system. In the illustrated off-axis printer 20, ink of each color for each printhead 70–76 is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to from an image on a media sheet 23 in the print-zone 25.

The printheads 70, 72, 74 and 76 each have an orifice plate (not shown) with a plurality of nozzles (not shown) formed therethrough in a manner well known to those skilled in the art. The nozzles of each printhead 70–76 may be formed in at least one, and often two linear arrays along the orifice plate. Thus, the term "linear" as used herein may be interpreted as "nearly linear" or substantially linear, and may include nozzle arrangements slightly offset from one another, for example, in a zigzag arrangement. Each linear array may be aligned in a longitudinal direction perpendicular to the scanning axis 46, with the length of each array determining the maximum image swath for a single pass of the printhead. The illustrated printheads 70–76 may be thermal inkjet printheads, although other types of printheads may be used, such as piezoelectric printheads. The thermal printheads 70–76 may include a plurality of resistors which are associated with the nozzles. Upon energizing a selected resistor, a bubble of gas is formed which ejects a droplet of ink from the nozzle and onto a sheet of paper in the print-zone 25 under the nozzle. The printhead resistors are selectively energized in response to firing command control signals delivered by a multi-conductor strip 78 from the controller 40 to the printhead carriage 45.

Fluid Circulation System

Figure 2:
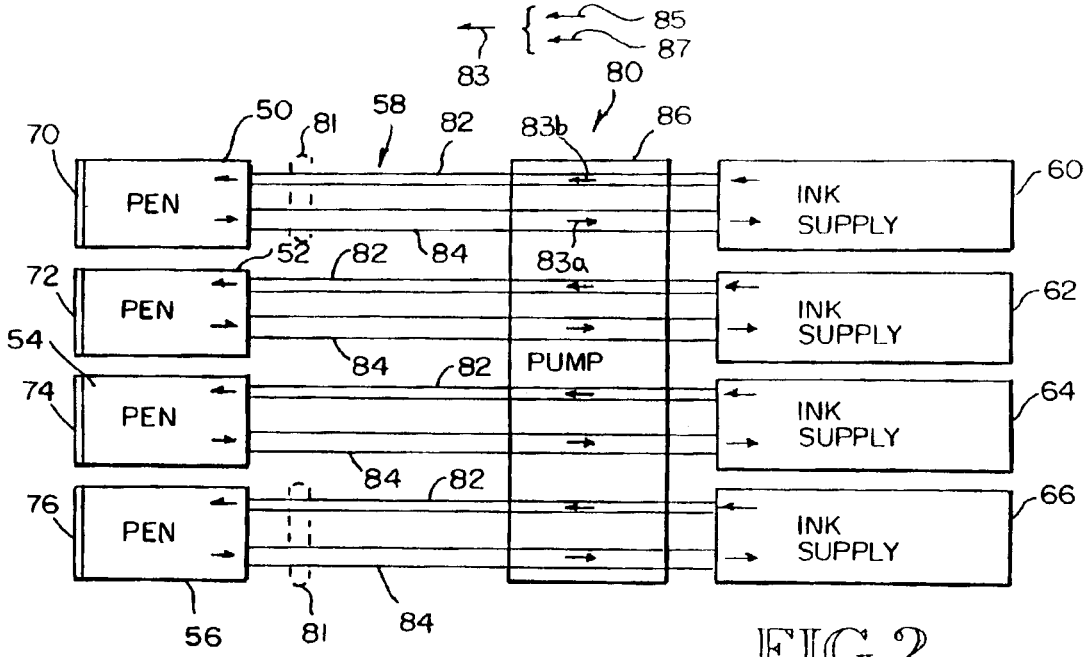
FIG. 2 is a diagram of an embodiment of an inkjet recording system having recirculating ink for a plurality of inkjet pens.
Figure 5:
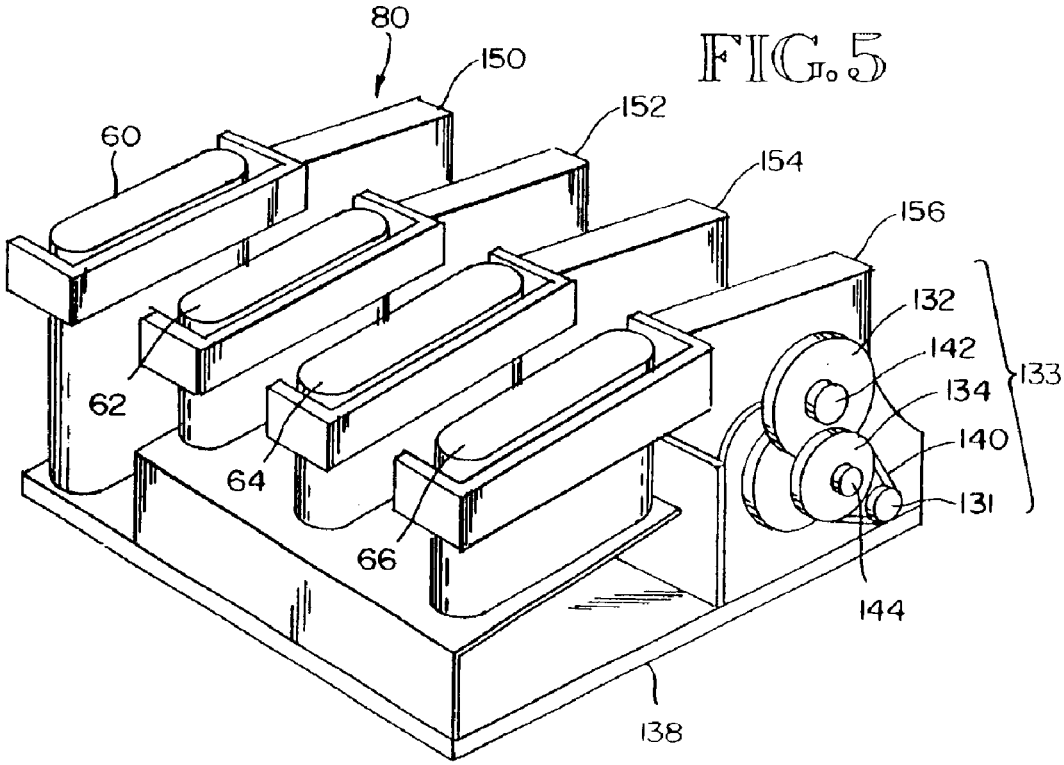
FIG. 5 is a perspective view of an embodiment of a pump and multiple ink supplies for an inkjet recording system having recirculating ink.
Figure 7:
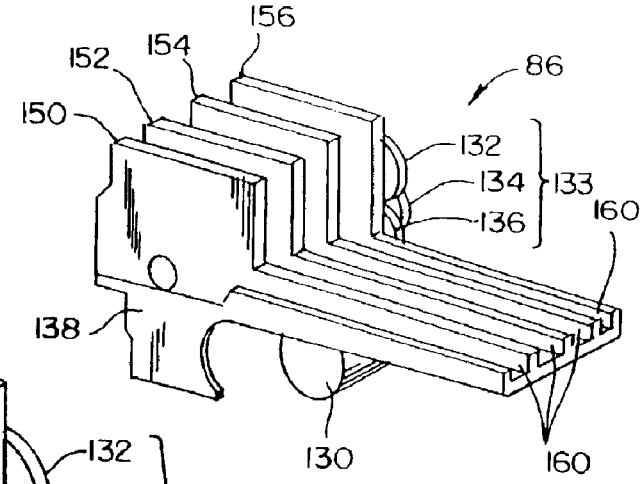
FIG. 7 is a perspective view of an embodiment of a pump station.
Figure 6:
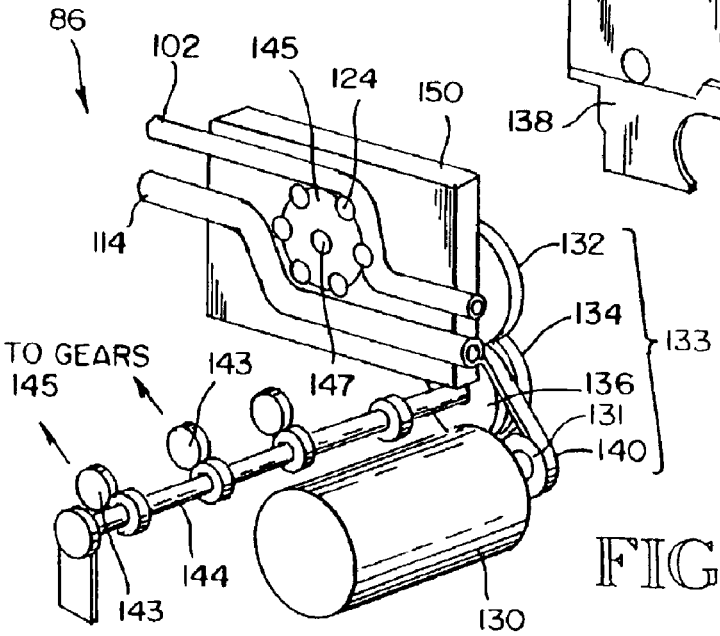
FIG. 6 is a perspective view of an embodiment of a portion of the pump of FIG. 5 without the ink supplies.

The inkjet printer 20 includes a recirculating ink, off-axis inkjet system 80 as shown in FIG. 2. The system 80 includes one or more inkjet pen cartridges 50–56 coupled to a corresponding one or more ink supplies 60–66 through the tubing system 58 and a pump 86. Each ink supply is coupled respectively to its corresponding pen by a fluid path pair 81. Each fluid path pair 81 has one fluid path 82 and another fluid path 84 which carry fluid 83. Fluid path 82 carries ink 85 from a respective ink supply to the corresponding pen. A small amount of air 87 also may be carried along the fluid path 82. The other fluid path 84 carries ink 85 and air 87 from the respective pen back to the corresponding ink supply. The pump 86 includes a common pump motor 130 (see FIG. 6) which drives a plurality of pump stations 150–156 (see FIG. 5). The common pump motor 130 provides a common motive force for driving all the pump stations 150–156. In an alternative embodiment multiple pumps may be used, in which each pump provides a common motive force.

Figure 3:
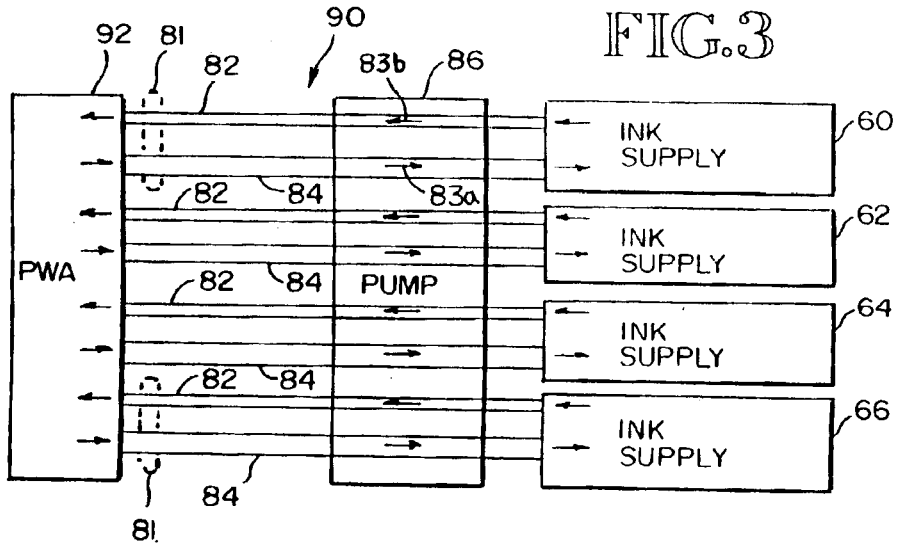
FIG. 3 is a diagram of an embodiment of an inkjet recording system having recirculating ink for a pagewide array inkjet pen.

Referring to FIG. 3, in another embodiment a recirculating inkjet printing system 90 includes a pagewide array inkjet pen 92. The pagewide array 92 spans an entire page width. Accordingly, the pagewide array 92 is not scanned over a media sheet, which is in contrast to the inkjet pens 50–56 of system 80 which are scanned.

Figure 4:
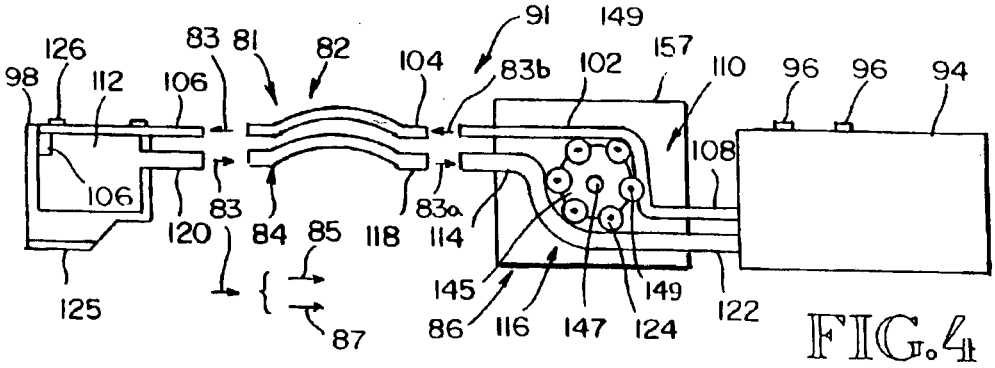
FIG. 4 is a diagram of an embodiment of a portion of an inkjet recording system for a given inkjet pen.

Referring to FIG. 4, a fluid circulation path 91 is shown for a given ink supply 94 and a corresponding pen 98. The ink supply 94 may be implemented by any one of the ink supplies 60–66 (see FIGS. 1–3). The pen 98 may be implemented by any one of the scanning pens 50–56 or a pagewide array inkjet pen 92. Fluid 83 circulates between the ink supply 94 and the pen 98, traveling through a pump station 157 and a fluid path pair 81. The pump station 157 may be implemented by one of multiple pump stations 150–156 (see FIG. 6). The fluid path pair 81 includes a first fluid path 82 implemented by a flexible tubing 104, and a second fluid path 84 implemented a flexible tubing 118. The fluid 83 flows from the ink supply 94 to the pen's reservoir 112, and from the reservoir 112 back to the ink supply 94. The fluid 83 includes ink 85 and air 87. The air enters and exits through one or more vents 96, 126. The ink supply includes one or more vents 96. The pen 98 includes a vent or valve 126.

Within the pump section 157 is a first flexible channel 102 and a second flexible channel 114. Each flexible channel 102, 114 is coupled to the ink supply 94. The first flexible channel 102 is part of the first fluid path 82 and is coupled to the flexible tubing 104. The second flexible channel 114 is part of the second fluid path 84 and is coupled to the flexible tubing 118. The first fluid path 82 is connected to an inlet port 106 of pen 98. The second fluid path 84 is connected to an outlet port 120 of pen 98.

The pump station 157 includes a gear 145 which rotates about an axis 147. Mounted to the gear 145 are a plurality of rollers 124 which rotate as the gear spins. Accordingly, each roller 124 rotates about its own axis 149 while revolving around the gear 145 axis 147. The rollers 124 press against the flexible channels 102, 114 implementing a peristaltic pumping action to pump fluid through the respective channels 102, 114.

Fluid 83 is pumped from the ink supply 94 along channel 102 through tubing 104 into the inlet port 106 leading to reservoir 112. This path to the pen 98 is referred to herein as the first fluid path 82. At the same time, fluid 83 also is pumped from the pen 98 reservoir 112 out the outlet port 120 along flexible tubing 118 and channel 114 back to the ink supply 94. This path back to the ink supply 94 is referred to herein as the second fluid path 84. Preferably, the volume of fluid 83*a* pumped along second fluid path 84 during a given interval of time (i.e., second fluid path flow rate) is greater than the volume of fluid 83*b* pumped along the first fluid path 82 during the same interval of time (first fluid path flow rate). The greater flow rate along the second fluid path 84 is achieved in one embodiment by having the flexible channel 114 of fluid path 84 within pump station 157 have a larger inner diameter than the flexible channel 102 of fluid path 82. As a result of the differing flow rate, more fluid volume is being pumped out of the pen along fluid path 84 than into the pen along path 82. However, the objective is to fill the pen 98 and maintain the pen in a generally full condition. Achieving a filling action is achieved by controlling the proportion of ink 85 in the fluid 83*a* which returns along the second fluid path 84 back to the ink supply 94.

The proportion of ink 85 in the fluid 83*b* flowing in the first fluid path 82 is generally constant. Ideally, all the fluid 83*b* is substantially ink 85. Although, in practice, a small proportion of the fluid 83*b* is air 87. Conversely, the proportion of ink 85 in the fluid 83*a* flowing in the second fluid path 84 varies according to a changing flow resistance occurring within the reservoir 112 of pen 98. The flow resistance generally varies according to the volume of ink in the reservoir 112. When the reservoir is near empty, the proportion of ink 85 in fluid 83 is relatively low, as compared to a relatively high proportion of ink 85 in fluid 83*a* when the volume of ink in the reservoir 112 is high. More specifically, the volume of ink exiting the pen 98 along the second path 84 is less than the volume of ink entering the pen 98 along path 82, so that a filling action causes the amount of ink in pen 98 to increase. Thus, the ink flow rate into the pen is greater than the ink flow rate out of the pen 98, while the fluid flow rate into the pen is less than the fluid flow rate out of the pen 98. The difference in flow rate is made up by an excess volume of air 87 flowing out of the pen 98 along path 84. A substantial portion of this excess air 87 enters the pen reservoir 112 through the vent or valve 126.

As the reservoir 112 fills, the proportion of ink 85 in fluid 83 flowing along the second fluid path back to the ink supply 98 generally increases. When the reservoir 112 reaches a threshold level, (e.g., a full condition), the volume of ink 85 flowing back to the ink supply 94 along the second fluid path 84 approximates the volume of ink 85 flowing into the reservoir 112 along the first fluid path 82. More precisely, when the threshold level has been achieved, the volume of ink 85 flowing into the reservoir 112 equals the volume of ink leaving the reservoir 112 through the printhead (during printing) plus the volume leaving the reservoir 112 along the second fluid path 84. As a result, the ink flow rate into the reservoir 112 approximately equals the ink flow rate out of the reservoir 112 through the printhead and the second fluid path 84 when the reservoir 112 is full. This change in ink flow rate along the second fluid path 84 in relation to the volume of ink in the reservoir 112 is referred to herein as a self-adjusting change. Also, note that it is the ink flow rate along the second fluid path 84 which is self-adjusting. The fluid flow rate remains generally constant while the pump 86 is active. Accordingly, while the pump 86 is active the ink flow rate along the first fluid channel 82 and the fluid flow rate along the first channel 82 remain generally constant, while the ink flow rate along the second fluid path 84 is self-adjusting and the fluid flow rate along the second fluid path 84 is generally constant.

An advantage achieved by the self-adjusting ink flow rate along the second fluid path 84 is that the reservoir 112 is maintained in a generally full condition. Accordingly, there is no need for the printing system to include sensors to detect when the reservoir 112 needs to be replenished are not required. Also, a computation of how much ink has been ejected and how much ink is to be supplied is not needed. In alternative embodiments, however, sensing or calculating methods may be implemented to determine when to activate the pump 86.

In a preferred embodiment each ink supply 94 is pressure-isolated from the corresponding pen 98. Each ink supply 94 has a vent 96 open to the ambient environment, and thus is maintained at generally atmospheric pressure. The pen 98 reservoir 112 in the vicinity of the printhead 125 is maintained at pressure less than atmospheric pressure. Less than atmospheric pressure is desired in the reservoir 112 so as to maintain a negative back pressure relative to the printhead nozzles of the pen 98. Such negative backpressure prevents ink from dribbling or drooling out of the printhead nozzles. In the embodiment illustrated in FIG. 4, the rollers 124 of pump station 157 provide pressure isolation between the reservoir 112 and the ink supply 94 by sealing off the fluid paths 82,84 within channels 102, 114 of the pump station 157. Specifically, the rollers 124 press against the flexible channels 102, 114 forming a seal at the points of contact. Pressure-isolating the supply 94 from the pen 98 prevents ink in the ink supply 94 from being siphoned to the reservoir 112 due to negative backpressure.

To maintain a desired backpressure where the pressure in the local reservoir 112 is slightly less than at the printhead nozzles, the flow of fluid 83 into the reservoir 112 is less than the flow 83 of fluid out of the reservoir 112. The specific backpressure maintained is based upon the pen design, the material properties of the pen and fluid paths, the rate of ink flow, and the amount and rate of ink being ejected through the printhead nozzles.

In one embodiment ink is continuously recirculated through the reservoir 112. In a multi-pen embodiment ink is continuously recirculated through each reservoir 112. In a cartridge with multiple reservoirs (e.g., a multi-color page wide array cartridge), ink is continuously recirculated through each pen portion (each of the independent channels and corresponding local reservoirs, such as for black ink and for each respective colored ink), and their respective fluid paths.

The continuous recirculation method may vary with the embodiment. For example, in one embodiment, fluid is recirculated between the ink supply 94 and reservoir 112 continuously while the printer power is on. In other embodiments, the pump 86 is operative to pump fluid 83 through the pump station(s) 157 during an active or "on" state. In an inactive or "off" state, the pump 86 does not pump fluid 83 through the pump station(s) 157. For example, in one alternative embodiment, fluid 83 need not be recirculated the whole time that the printer power is on. Instead, the fluid 83 may be recirculated between the ink supply 94 and reservoir 112 during every print job, or may be recirculated after a prescribed number of print jobs. Accordingly, the pump 86 is active during each print job, or after a prescribed number of print jobs. Still another approach is to estimate the amount of ink used for a print job and enable the pump 86 to pump fluid between the ink supply 94 and reservoir 112 each time the controller 40 estimates that the pen reservoir 112 level has gone down to a prescribed level. In still another embodiment, a sensor may be included to detect the level of ink in a reservoir 112 or in an ink supply 94. In such an embodiment, the pump 86 is activated to recirculate ink between the ink supply 94 and reservoir 112 when the reservoir 112 gets down to a prescribed level. Note that when the pump 86 is activated, each reservoir 112 in the pen 92 or all the reservoirs among pens pens 50–56 are refilled, because a common motive force is implemented through the pump motor 130 to each pump station 157 for each of the fluid path pairs 81.

Pump 86

Referring to FIGS. 4–7 the pump 86 includes a pump motor 130, a power train 133, a housing 138 and a plurality of removable pump stations 150–156. In one embodiment, the power train 133 includes a plurality of gears 131, 132, 134, 136, a drive belt 140, an axle 144 and pump station coupling gears 143. When the pump 86 is in an active state, the motor 130 drives the power train 133. The power train 133 translates a rotational action of the pump motor 130 to drive the coupling gears 143. In one embodiment each coupling gear 143 is driven off axle 144. Each coupling gear 143 couples to a gear 145 of a corresponding pump station 150–156. When the pump is in the active or "on" state, gear 145 of each pump station 150–156 is rotated. Mounted to the gear 145 are a plurality of rollers 124 which rotate as the gear 145 spins. Each roller 124 rotates about its own axis 149 (see FIG. 4) while revolving around the gear 145 axis 147. Within each pump station 150–156 there are two flexible channels 102, 114. The rollers 124 press against the flexible channels 102, 114 implementing a peristaltic pumping action to pump fluid through the respective channels 102, 114. By driving each gear 145 in common, the pump motor 130 provides a common motive force for driving each pump station 150–156.

Because each channel 102, 114 is receiving a common motive force, the volume of fluid pumped per unit of time is determined by the inner diameter of each channel 102, 114. By selecting the inner diameter appropriately, different fluid flow rates can be achieved between channels 102 and 114, or among channels 102 of different pump stations 150–156 and among channels 114 of different pump stations 150–156. In one embodiment, the internal diameter of each channel 102 is the same for each pump section 150–156. Accordingly, in such embodiment the fluid flow rate along each channel 102 (and corresponding fluid path 82) among the plurality of pens 50–56 is the same. In another embodiment, the internal diameter of each channel 114 is the same for each pump station 150–156. Accordingly, in such embodiment the fluid flow rate along each channel 114 (and corresponding fluid path 84) among the plurality of pens 50–56 is the same. In another embodiment, the internal diameter of the channel 102 of each pump station 150–156 is less than that of each corresponding channel 114. Accordingly, in such embodiment, the fluid flow rate along each channel 102 (and corresponding fluid path 82 is less than the fluid flow rate along each corresponding channel 114 (and corresponding fluid path 84) for the plurality of pens 50–56.

In still another embodiment, the internal diameter of channel 102 for one pump station 150 is different than the internal diameter 102 for the other pump stations 152–156. In addition, the internal diameter of channel 114 for one section 150 is different than the internal diameter 114 for the other pump stations 152–156. Accordingly, the fluid flow rate in channel 102 of pump station 150 is different from the fluid flow rate in the channels 102 of the other pump stations 152–156; and the fluid flow rate in channel 114 of pump station 150 is different from the fluid flow rate in the channels 114 of the other pump stations 152–156.

In another embodiment, a common motive force is implemented for each pump station 150–156. Therefore, the respective fluid flow rates within each pump station 150–156 are determined by the respective internal diameters of the fluid channels 102, 114. For example, in one embodiment a higher flow rate may be implemented for a black ink pen by having a larger internal diameter at the pump station channels 102, 114 for the black pen, relative to the corresponding components in the flow paths of the other pens.

One skilled in the art will appreciate that other pump configurations may be utilized. For example, independent drives may be implemented using individual pump motors 130 for each station 150–156 or for subsets of the stations 150–156. In another example, a transmission system may be implemented to rotate each gear 145 at a different rate.

Inkjet Pen

Referring to FIG. 8, the inkjet pen 98A has a body 99 defining an internal reservoir 112 filled with a porous material 162. In various embodiments the porous material 162 may be made of polyurethane foam or a bonded polyester fiber. In another embodiment, the reservoir 112 may be filled with glass beads. Fluid 83, including ink 85 and a small proportion of air 87 flows into the pen 98 through an inlet port 106. Within the reservoir 112, ink 85 migrates through a filter 164 toward the printhead 125. The printhead 125 includes nozzles through which ink drops are ejected during a print job. During ink circulation between the ink supply 94 and reservoir 112 (see FIG. 4), fluid 83 including ink 85 and air 87 flows out of the pen through an outlet port 120 back toward the corresponding ink supply 98. The ink 85 enters the internal reservoir 112 at an opening 168. In an exemplary embodiment the opening 168 is at a lower elevation than the output port 120. This assures that the fluid movement within the reservoir 112 is not limited to an upper portion of the reservoir 112.

An air vent 126 penetrates the body 99 to allow air 87 to be drawn into or out of the reservoir 112. As fluid circulates between the ink supply 94 (see FIG. 4) and the reservoir 112, air 87 is drawn in from the vent 126 to be part of a volume of fluid 83 exiting the reservoir 112 through the outlet port 120. As previously described, fluid is being circulated to fill the reservoir 112 and maintain the reservoir 112 at a generally full condition. Such process is performed continuously in some embodiments, and may be performed intermittently in other embodiments. However, during circulation the flow of fluid 83 out of the reservoir 112 exceeds the flow of fluid into the reservoir 112. In filling the reservoir 112 or maintaining a level of ink in the reservoir, a portion of the fluid exiting includes air 87. This air 87 enters the reservoir in part from the vent 126.

Although the fluid flow rate of fluid 83 exiting the reservoir 112 is greater than the fluid flow rate of fluid 83 entering the reservoir 112, the ink flow rate of ink exiting the reservoir 112 varies in a self-adjusting manner. Such self-adjustment is to maintain the reservoir 112 at a desired fill level. The self-adjusting ink flow for pen 98A is now described.

The volume of ink 85 in the porous material 162 (i.e., the degree of ink saturation of the porous material 162) affects the fluid flow resistance for fluid exiting the reservoir 112 of pen 98A through outlet port 120. Consider a case where the pen is primed and the ink level is very low. Due to the low level of ink, the porous material 162 offers a high resistance to the flow of ink 85 out the port 120 because the porous material 162 air portions are absorbing the ink 85. As the porous material 162 fills with ink 85 (i.e. becoming more saturated), the flow resistance decreases because less ink 85 can be absorbed and thus more ink 85 passes through the porous material 162 without being absorbed. Note that the ink flow rate into the pen is the same regardless of the saturation level. Thus, during recirculation of fluid 83 between the ink supply 94 and reservoir 112, fluid 83 enters the reservoir 112 through inlet port 106 at a first substantially constant rate, while fluid 83 exits the reservoir 112 through port 120 at a second substantially constant rate. As discussed above, the second rate is greater than the first rate. The proportion of ink 85 in the fluid 83 exiting the pen 98A through port 120 varies according to the ink flow resistance. The ink flow resistance depends on the volume of ink in the reservoir 112, which in this embodiment corresponds to the saturation of the porous material 162. The ink flow resistance also depends on the volume or air entrapped in the porous media. As the porous material 162 becomes increasingly saturated, the proportion of ink 85 in the fluid 83 exiting the outlet port 120 increases. As the pen 98A prints ink 85 and the porous material 162 becomes less saturated, the proportion of ink 85 in the fluid 83 exiting the pen 98A decreases. Note that in both cases the total volume of fluid 83 exiting the outlet port 120 remains generally constant. The variation in ink flow is offset by a variation in air flow. As the proportion of ink 85 exiting the pen 98A through the outlet 120 increases, the proportion of air 87 leaving through the outlet 120 decreases to maintain a generally constant fluid flow. Similarly, as the proportion of ink 85 exiting the pen 98A through the outlet 120 decreases, the proportion of air 87 leaving through the outlet port 120 increases to maintain a generally constant fluid flow.

In an implementation where the ink is recirculated constantly or during each print job, the volume of ink 85 in the reservoir 112 does not change significantly. The reservoir 112 is maintained at a generally full condition (or at some other generally constant level according to the design). Ideally, the volume of ink 85 entering the pen 98A through the inlet port 106 is equal to the sum of the volume of ink 85 leaving the reservoir 112 through the outlet port 120 and through the printhead 125. Thus, when ink 85 is ejected from the printhead 125 the volume of ink 85 entering the reservoir 112 is greater than the volume of ink 85 leaving the reservoir 112 through port 120.

In an implementation where the ink is recirculated in response to a sensed or calculated condition, the reservoir 112 is likely to be less than full when the ink recirculation process commences. While filling the reservoir 112, there is a net flow of ink 85 into the reservoir 112. When reservoir 112 is full, there is no net fluid flow into or out of the reservoir 112 as the fluid flow in via inlet port 108 equals the fluid flow out via printhead 125 and outlet port 120.

Because the proportion of ink 85 in the fluid 83 exiting the reservoir 112 through outlet port 120 is self-adjusting according to the volume of ink in the reservoir 112, the reservoir 112 is prevented from overfilling. As the reservoir 112 gets near the full level, the flow rate of ink 85 out the reservoir 112 through outlet port 120 is approximately equal to flow rate of ink 85 into the reservoir 112 through inlet port 106. This self-adjusting feature occurs for each pen 50–56 reservoir 112. The self-adjusting proportion of ink 85 for one reservoir 112 is independent of the self-adjusting proportion of ink 85 occurring at the other reservoirs 112. As fluid 83 circulates between a respective pen reservoir 112 and its corresponding ink supply 98, each pen 50–56 reservoirs 112 gets refilled with an ink flow rate out of the respective reservoir 112 determined according to the volume of ink 85 (and entrapped air) in such reservoir 112. In particular, even though each pen 50–56 may have a different capacity, different ink, or a different backpressure, the proportions of ink 85 in the fluid 83 exiting the respective reservoirs 112 for each pen 50–56 is self-adjusting according to the volume of ink 85 in the corresponding reservoir 112.

Referring to FIG. 9, in an alternative embodiment a pen 98B may include an accumulator 170 and bubble generator 176 in place of the porous media 162. The vent 126 leads to the accumulator 170. The accumulator 170 is filled with air and expands and contracts with changes in temperature and altitude to maintain a desired pressure level in the reservoir 112 relative to a pressure at the printhead 125 nozzles, (i.e., referred to as a back pressure). The bubble generator 176 includes a ball 180 within a channel 177. When the pressure in the reservoir 112 reaches a certain level, pressure on the ball 180 is enough to allow passage of an air bubble 178 (e.g., by unseating the ball enough to allow passage of the air bubble 178, or in another embodiment to pull air through a meniscus between the ball and a ribbed seal (not shown)).

Ink is received into the reservoir 112 of pen 98B through the inlet port 106. The reservoir 112 has a volume of ink 172 and a volume of air 174. Air 87 enters the reservoir 112 through the bubble generator 176. The reservoir 112 pressure and the elevation of the outlet port 120 determine the level of ink 172 maintained in the reservoir 112. While the pump 86 (see FIGS. 4–7) is in an "on" state, fluid 83 circulates into the reservoir 112 through inlet port 106 and out of the reservoir 112 through the outlet port 120. Because the flow rate of fluid 83 exiting the reservoir 112 is greater than the flow rate of fluid 83 entering the reservoir 112, there is a tendency for the pressure in the reservoir 112 to decrease. This decrease, however, causes the accumulator to expand. In turn air 87 enters into the reservoir 112 through the bubble generator 176. The net effect on the reservoir pressure is for the reservoir 112 pressure to remain generally constant at some pressure less than atmospheric pressure, (i.e., at the negative backpressure of the pen). As the level of ink 172 changes within the reservoir 112 due to printing or fluid circulation, the accumulator 170, which in effect is a bellows filled with air, expands or contracts in order to maintain the pressure of reservoir 112 at a generally constant level.

While the pump 86 is in an "off" state, the ejection of ink 85 through the printhead 125 creates the negative pressure tendency in the reservoir 112. This tendency causes the accumulator 170 to expand. As the accumulator 170 expands, air bubbles 178 enter the reservoir 112 through the bubble generator 176. The net effect on the reservoir 112 pressure is for the reservoir pressure to remain generally constant. Operation of the accumulator 170 is described more completely in the commonly-assigned U.S. Pat. No. 5,505,339 issued Apr. 9, 1996 for "Pressure-Sensitive Accumulator for Ink-Jet Pens" of Cowger et al. Such patent is incorporated herein by reference and made a part hereof.

Still referring to FIG. 9, consider the case where the reservoir 112 of pen 98B is near empty. In such case, a large volume of air has entered through the bubble generator 176 over the course of emptying the reservoir 112, while the accumulator 170 has expanded to accommodate the large volume of air. When the pump 86 is active, fluid circulates between an ink supply 94 and the pen 98B reservoir 112. Fluid 83 including mostly ink 85 enters the reservoir at inlet port 106. Fluid 83 including ink 85 and air 87 exits the reservoir at outlet port 120. The flow rate of fluid 83 exiting the reservoir 112 exceeds the flow rate of fluid 83 entering the reservoir 112. The net effect is an increase in ink 85 within the reservoir 112 and a decrease in air 87 within the reservoir 112. As ink 85 fills the reservoir, the accumulator 170 tends to remain expanded. Air 178 is pulled into the reservoir 112 through the bubble generator 176. Such air 178 provides the source for the air 87 in the fluid 83 exiting the outlet port 120.

When the reservoir 112 is full, and fluid 83 continues to be circulated into the inlet port 106 and out of the outlet port 120, the volume of ink 85 entering inlet port 106 is substantially equal to the volume of ink 85 exiting the outlet port 120 and the volume of ink being ejected from the printhead 125. However, there is a greater volume of fluid 83 exiting the outlet port 120. This excess volume is filled with air 87 drawn into the reservoir 112 through the bubble generator 176.

The pen 98B includes a standpipe region 181 between the filter 164 and the printhead 125. It is undesirable for air to accumulate within the standpipe region 181. Over the life of the pen 98B, air collects in the standpipe region 181 from outgassed air from the ink and from bubbles which collect as the printhead nozzles fire. When a certain volume of air accumulates in the standpipe region 181, ink 172 no longer flows easily through the filter 164, thereby ending the useful life of the pen 98B. The bubble generator 176 is located at an elevation between an elevation of the standpipe region 181 and the reservoir 112.

FIG. 10 shows another embodiment of a pen 98C implementing an accumulator 170 and a bubble generator 176 which extends the useful life of a pen. The useful life is extended because air occurring between the filter 164 and the printhead 125 is able to be drawn out the outlet port 120.

Pen 98C includes a first reservoir chamber 112 which receives ink from the inflow port 106. The filter 164 is located at the base of the reservoir chamber 112. Ink 85 passes through the filter 164 into a second reservoir chamber 113. The outlet port 120 is in open communication with the second reservoir chamber 113. Stated more significantly, in pen 98C the outflow of fluid at port 120 is directly coupled to the contiguous space between the filter 164 and the printhead 125. Further, the bubble generator 176 also is in open communication with the second reservoir chamber 113. Still further, the accumulator 170 also is in fluid communication with the reservoir chamber 113 through aperture 171. The outlet port 120 is in fluid communication with the second reservoir chamber 113. Therefore, as ink 85 flows into the inlet 106, ink 85 and air 87 is pushed through the filter screen 164 into the second reservoir chamber 113 from the first reservoir chamber 112.

By positioning the accumulator 170 and bubble generator 176 in fluid communication with the second reservoir chamber 113, pressure at the printhead 125 is regulated so that the printhead 125 remains primed. Air entering the reservoir chamber 113 may enter from three sources. As one source, bubbles 117 enter through the bubble generator 176. As another source, bubbles 119 enter the second reservoir chamber 113 from the accumulator 170 via aperture 171. As another source, bubbles 121 enter the second reservoir chamber 113 by collecting as out-gassing from the printhead 125. Air 87 and ink 85 flow out of the reservoir chamber 113 through the outlet port 120 back to an ink supply 94 (see FIG. 4). The fluid flow through the outlet port 120 opposes diffusion of air 87 from the second reservoir chamber 113 back into the first reservoir chamber 112 The accumulator 170 and bubble generator 176 function as described above with regard to FIG. 9 to regulate the pressure within the reservoir chambers 112, 113.

In addition to the advantage of increasing the useful life of the pen, the pen 98C also provides a path for circulating ink to pass along the back surface of the printhead 125. Accordingly, the printhead 125 is cooled by the circulating ink 85.

Figure 11:
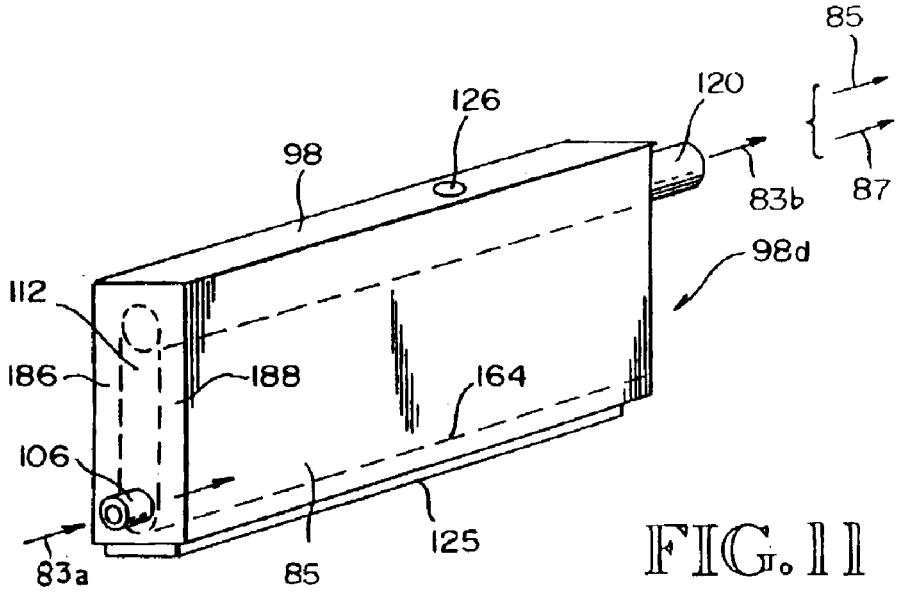
FIG. 11 is a perspective view of an embodiment of an inkjet pen having capillary plates.

Referring to FIG. 11, in still another embodiment, pen 98D includes a narrow reservoir 112. Two plates 186, 188 are spaced at a narrow distance so that surface adhesion of the ink 85 against the plates 186, 188 causes a capillary force to act on the ink 85. The capillary force decreases with elevation within the reservoir 112. The printhead 125 is at the base of the reservoir 112. Accordingly, the capillary force decreases with elevation of ink 85 away from the printhead 125. With a larger force near the printhead, ink is drawn to the printhead 125.

The inflow port 106 is located at a low elevation relative to the height of the reservoir 112. The outflow port 120 is located at a high elevation relative to the height of the reservoir 112. The outflow port 120 elevation relative to the inflow port 106 elevation, along with the capillary action attributed to the closely spaced plates 186, 188 determines the height of ink in the reservoir 112 corresponding to a full reservoir 112. Also, the respective elevations of the inflow port 106 and outflow port 120 assure that the printhead 125 is in the ink circulation path.

As ink 85 fills the reservoir 112, the ink 85 rises toward the elevation of the outflow port 120. The elevation of the outflow port 120 is at a height above the printhead 125 where the pressure in the reservoir 112 when filled with ink 85 to such outlet port elevation is generally equal to the desired backpressure set point for the pen 98D (e.g., a desired reservoir pressure which is less than the pressure at the printhead nozzles.). Ink flowing into the reservoir 112 from the inlet port 106 causes ink rising to the outlet port to be drawn off through the outflow port 120 when the ink rises to or above the outflow port 120 elevation. This prevents a pressure greater than the desired backpressure set point from occurring within the reservoir 112. Correspondingly, this prevents the volume of ink between the printhead 125 and the filter 164 from overfilling.

Figure 12:
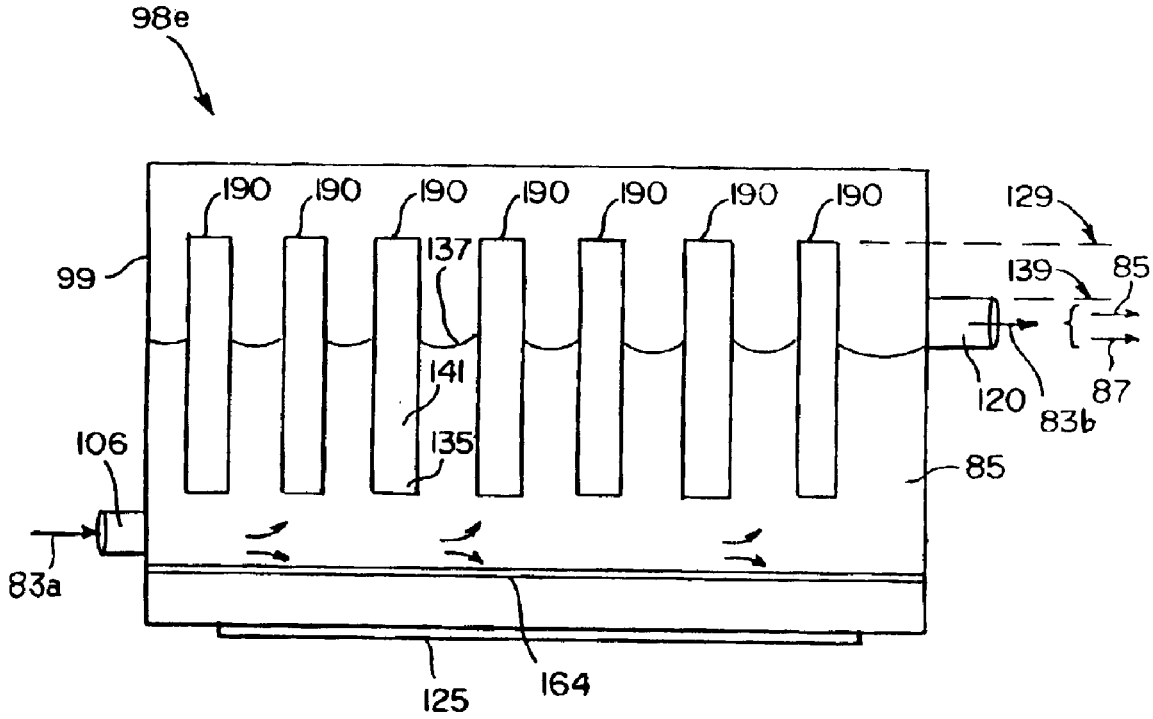
FIG. 12 is a schematic view of an embodiment of a portion of an inkjet pen having a plurality of capillary tubes within the pen reservoir.

Referring to FIG. 12, in still another embodiment a pen 98 E includes a body 99 housing a reservoir 112. Within the reservoir 112 are closely spaced rods 190. The rods 190 are aligned in parallel having a common height 129 exceeding the elevation of the outlet port 120. The inlet port 106 is at an elevation below a base level 135 of the rods 190. In one embodiment the rods 190 are solid. In another embodiment the rods are hollow tubes. The rods are spaced close enough to cause the surface adhesion of the ink against the rods 190 to produce a capillary force. The ink 85 between each rod forms a meniscus 137 occurring at an elevation along the rods 190. For the rods 190 located closer to the outlet port 120, the meniscus 137 is at a slightly lower elevation as compared to those farther away from the outlet port 120.

For the various embodiments described above having a single pen or multiple pens, higher fluid flow rates can be changed uniformly and dynamically by adjusting the speed of the pump. Alternatively, a transmission may be implemented to vary the gear linkage and change the pumping rate transmitted to the fluid path pairs 81. As previously described, the fluid flow rate also can be adjusted by changing the inner diameter of the fluid channels 102, 114.

In a multiple pen embodiment the fluid flow rates for a given pen may differ from those of other pens according to the differing inner diameters of the fluid channels 102, 114 of the pump station associated with each such pen. Alternatively, the gear ratio used for pumping fluid through a given fluid path pair can differ to achieve different flow rates for different pens. For example, a black pen may require a higher fluid rate in the associated fluid path pair 81.

Note that the tubes used for a pen to form a portion of the associated fluid path pair 81 may be shipped with the ink supply so as to be replaced with each ink supply 94. Thus, the tube life and size may be matched to the volume of ink in the ink supply.

While the above is discussed in terms of preferred and alternative embodiments, the invention is not intended to be so limited.

What is claimed is:

1. A recirculating inkjet printing method, comprising:

storing ink at an ink supply;

flowing a first fluid, including the ink, from the ink supply to a reservoir;

flowing a second fluid, including the ink and air, from the reservoir to the ink supply; and adjusting a proportion of ink in the second fluid so as to maintain a predetermined ink level in the reservoir, wherein the flowing of the first fluid is at a first rate and wherein the flowing of the second fluid is at a second greater rate.

2. A recirculating inkjet printing method according to claim 1, further comprising:

depositing a portion of the ink from the reservoir onto a print medium.

3. A recirculating inkjet printing method according to claim 2, wherein the adjusting further comprises maintaining a predetermined pressure within the reservoir.

4. A recirculating inkjet printing method according to claim 1, wherein the adjusting comprises admitting air into the reservoir.

5. A recirculating inkjet printing method according to claim 1, further comprising:

generating a common motive force to flow the ink from the ink supply to the reservoir and from the reservoir to the ink supply.

6. A recirculating inkjet printing method according to claim 1, wherein said adjusting the proportion of ink is based on a volume of ink in the reservoir.

7. A recirculating inkjet printing method according to claim 1, wherein the flowing of the first fluid is simultaneously performed with the flowing of the second fluid.

8. A recirculating inkjet printing method according to claim 1, including drawing air into the reservoir during the flowing of the second fluid.

9. A recirculating inkjet printing method according to claim 1, including drawing air into the reservoir during the flowing of the first fluid.

10. A recirculating inkjet printing method according to claim 1, wherein the reservoir includes a filter separating the reservoir into a first portion and a second portion and wherein the flowing of the first fluid is into the first portion of the reservoir and wherein the flowing of the second fluid is from the first portion of the reservoir.

11. A recirculating inkjet printing method according to claim 10, wherein the second portion is between the filter and a printhead supplied with ink by the reservoir.

12. A recirculating inkjet printing method according to claim 1, including flowing the first fluid into the reservoir at a first location and flowing the second fluid from the reservoir at a second location above the first location.

13. A recirculating inkjet printing method according to claim 12, wherein the second location is at an elevation substantially equal to a desired back pressure set paint for a printhead supplied with ink from the reservoir.

14. A recirculating inkjet printing method according to claim 1, including venting air from the ink supply.

15. A recirculating inkjet printing method according to claim 4, wherein the venting of the air is during the flow of the second fluid.

16. A recirculating inkjet printing method according to claim 1, including preventing venting of air from the reservoir to atmosphere during flowing of the first fluid to the reservoir.

17. A recirculating inkjet printing method according to claim 1, wherein the flowing of the first fluid is by rotatably driving rollers against a first flexible channel to displace the first fluid within the first channel.

18. A recirculating inkjet printing method according to claim 17, wherein the flowing of the second fluid is by rotatably driving rollers against a second flexible channel to displace the second fluid within the second channel.

19. A recirculating inkjet printing method according to claim 1, wherein the ink supply has a constant internal volume during flowing of the first fluid and during flowing of the second fluid.

20. A recirculating inkjet printing system, comprising:

reservoir means for storing ink;

ink supply means for supplying ink to the reservoir means;

first fluid path means for flowing fluid, including ink, from the ink supply means to the reservoir means at a first rate;

printing means for depositing a portion of the ink received from the reservoir means onto a medium;

second fluid path means for flowing fluid, including the ink and air, from the reservoir means to the ink supply means at a second greater rate; and means for adjusting a proportion of the ink in the fluid carried from the reservoir means to the ink supply means to prevent overfilling the reservoir means.

21. A recirculating inkjet printing system according to claim 20, wherein the adjusting means comprises means for admitting air into the reservoir.

22. A recirculating inkjet printing system according to claim 21, further comprising means for maintaining a pressure within the reservoir.

23. A recirculating inkjet printing system according to claim 21, in which the adjusting means further comprises a porous media in the reservoir, and wherein the ink proportion adjusts relative to a degree of saturation of the porous media with ink.

24. A recirculating inkjet printing system according to claim 20, further comprising:

means for generating a common motive force to circulate ink along the first and second fluid path means.

25. A recirculating inkjet printing system, comprising:

an inkjet cartridge having a local reservoir and a printhead, the printhead having a plurality of nozzles, wherein ink from the local reservoir is supplied to the plurality of nozzles;

an ink supply;

a first fluid path along which fluid flows from the ink supply to the reservoir;

a second fluid path along which fluid flows from the reservoir to the ink supply; and a recirculating pump which exerts a common motive force for driving fluid along the first and second fluid paths, wherein fluid flow along the second path is greater than the fluid flow along the first path, said fluid along the second path comprising ink and air.

26. A recirculating inkjet printing system according to claim 25, further comprising an opening through which the air is introduced into the reservoir.

27. A recirculating inkjet printing system according to claim 26, wherein the air contributes to an adjustment of a proportion of ink in the fluid carried from the reservoir to the ink supply so that the pump fills the reservoir with ink without overfilling.

28. A recirculating inkjet printing system according to claim 25, further comprising a porous medium within the reservoir, and wherein an increased saturation level of ink in the porous medium causes the proportion of ink in the fluid flowing along the second fluid path to increase without altering the pump rate.

29. A recirculating inkjet printing system according to claim 25, in which the second fluid path has a larger cross section than the first fluid path to achieve greater fluid flow at the same motive force of the pump.

30. A recirculating inkjet printing system according to claim 25, in which the pump has an "on" state during which the common motive force is generated and an "off" state during which fluid flow along the first fluid path and second fluid path is precluded.

31. A recirculating inkjet printing system according to claim 25, in which the cartridge further comprises a bubble generator, the bubble generator including an opening to draw air into the reservoir around a ball according to pressure within the reservoir wherein, as ink pressure in the reservoir decreases, air drawn from the bubble generator flows out along the second fluid path to decrease the proportion of ink flowing along the second fluid path.

32. A recirculating inkjet printing system according to claim 31, in which the cartridge further comprises a filter between the reservoir and the printhead through which ink passes, wherein air on a printhead side of the filter flows along the second fluid path.

33. A recirculating inkjet printing system according to claim 25, in which the inkjet cartridge moves along an axis to eject ink onto a media, and in which the ink supply does not move with the inkjet cartridge along said axis.

34. A recirculating inkjet printing system according to claim 25, in which the inkjet cartridge is a pagewide array cartridge.

35. A recirculating inkjet printing system according to claim 25, in which the inkjet cartridge comprises a pair of closely spaced plates, the reservoir occupying the region between the plates, wherein ink flows within the reservoir to the printhead under capillary action in which a capillary force decreases with distance away from the printhead.

36. A recirculating inkjet printing system according to claim 25, in which the cartridge comprises a plurality of capillary tubes within the reservoir, wherein ink flows along the tubes toward the printhead under capillary action, wherein a capillary force decreases along each capillary tube with distance away from the printhead.

37. A recirculating inkjet printing system, comprising:

a multi-color inkjet pen having a plurality of ink reservoirs and an inkjet printhead, wherein ink from the plurality of ink reservoirs is supplied to the inkjet printhead;

a plurality of ink supplies;

a plurality of fluid path pairs, each fluid path pair connecting a corresponding one of the ink reservoirs to a corresponding one of the ink supplies, each fluid path pair comprising a first fluid path along which fluid flows into the corresponding ink reservoir from the corresponding ink supply and a second fluid path along which fluid flows from the corresponding ink reservoir to the corresponding ink supply; and a recirculating pump which exerts a common motive force to drive fluid along the plurality of fluid path pairs, wherein fluid flow along the second fluid path of each fluid path pair is greater than fluid flow along the first fluid path of each fluid path pair, said fluid along each said second path comprising ink and air.

38. A recirculating inkjet printing system of claim 37, further comprising:

a respective opening associated with each one of the plurality of reservoirs through which air is introduced into the corresponding reservoir to adjust a proportion of ink in the fluid carried along the second fluid path associated with said corresponding reservoir.

39. A recirculating inkjet printing system according to claim 37, in which the pump has an "on" state during which the common motive force is generated for each pair of fluid paths, and an "off" state during which fluid flow along the first fluid path and second fluid path is precluded for each pair of fluid paths.

40. A recirculating inkjet printing system according to claim 39, in which the pump, while in the "on" state, maintains a constant motive force for each pair of fluid paths causing a fluid flow rate along the first path of said pair of fluid paths to be substantially constant and a fluid flow rate along the second path of said pair of fluid paths to be substantially constant, with the fluid flow rate along the second path greater than the fluid flow rate along the first path, wherein a proportion of ink within the fluid flowing along the second path of each said pair of fluid paths is self-adjusting preventing overfill of each said corresponding reservoir.

41. A recirculating inkjet printing system according to claim 40, in which the fluid flow rate in the first fluid path of a first fluid path pair differs from a fluid flow rate through a first fluid path of a second fluid path pair.

42. The system of claim 40, wherein a first inner channel diameter of the first fluid path of the first pair differs from a second inner channel diameter of the first fluid path of the second pair.

43. A recirculating inkjet printing system, comprising:

a plurality of inkjet cartridges, each cartridge having an ink reservoir, an opening which introduces air into the reservoir, and an inkjet printhead, the printhead having a plurality of inkjet nozzles, wherein ink from the reservoir is supplied to the plurality of inkjet nozzles;

at least one ink supply;

a plurality of fluid path pairs, each fluid path pair connecting a corresponding one of said inkjet cartridges to a corresponding one of said at least one ink supply, each fluid path pair comprising a first fluid path along which fluid flows from the corresponding ink supply to the corresponding reservoir, and a second fluid path along which fluid flows from said corresponding reservoir to the corresponding ink supply; and a recirculating pump which exerts a common motive force for driving fluid through the plurality of fluid path pairs, wherein fluid flow along the second fluid path of each said fluid path pair is greater than fluid flow along the first path for each fluid path pair, said fluid along the second path comprising ink and air; and wherein air introduced into the reservoir of one of said plurality of inkjet cartridges contributes to a self-adjustment of a proportion of ink in the fluid carried along the second fluid path associated with said reservoir of said one of said plurality of inkjet cartridges.

44. A recirculating inkjet printing system according to claim 43, in which the pump, while in an on state, maintains a constant motive force for each pair of fluid paths causing fluid flow along the first path of said pair of fluid paths to be substantially constant and fluid flow along the second path of said pair of fluid paths to be substantially constant with fluid flow along the second path greater than fluid flow along the first path, wherein a proportion of ink within the fluid flowing along the second path of each said pair of fluid paths is self-adjusting preventing overfill of each said corresponding reservoir.

45. A recirculating inkjet printing method, comprising:

ejecting ink of a first color from a printhead coupled to a first reservoir, the first reservoir coupled to a first ink supply through a first fluid path pair, wherein the first fluid path pair includes a first fluid path along which fluid moves from the first ink supply to the first reservoir and a second fluid path along which fluid moves from the first reservoir to the first ink supply;

ejecting ink of a second color from a second printhead coupled to a second reservoir, the second reservoir coupled to a second ink supply through a second fluid path pair, wherein the second fluid path pair includes a third fluid path along which fluid moves from the second ink supply to the second reservoir and a fourth fluid path along which fluid moves from the second reservoir to the second ink supply;

circulating with a common motive force ink of the first color through the first fluid path pair and ink of the second color through the second fluid path pair, wherein fluid flow along the second path is greater than fluid flow along the first path and fluid flow along the fourth fluid path is greater than fluid flow along the third fluid path, said fluid along the second path and fourth path comprising ink and air; and adjusting a proportion of ink in the fluid of the second fluid path and fourth fluid path to prevent overfilling.

46. An inkjet printing method according to claim 45, in which the cartridge has a first vent through which air is drawn into the first reservoir and the first reservoir comprises a porous medium, and wherein an increased saturation level of ink in the porous medium causes the proportion of ink in the fluid flowing along the second fluid path to increase without altering the common motive force of the pump.

47. A printing system comprising:

an ink reservoir;

an ink supply; and at least one pump configured to pump fluid from the ink supply to the reservoir at a first rate and to pump fluid from the reservoir to the ink supply at a second greater rate.

48. A printing system comprising:

an ink reservoir;

an ink supply;

at least one pump configured to simultaneously pump fluid from the ink supply to the reservoir at a first rate and to pump fluid from the reservoir to the ink supply at a second greater rate.

49. A printing system comprising:

an ink supply;

a printhead;

a reservoir having a filter separating the reservoir into a first portion and a second portion; and at least one pump configured to pump fluid from the ink supply to the reservoir at a first location along the first portion and to pump fluid from a second location the first portion of the reservoir to the ink supply.

50. The system of claim 49, wherein the second portion is proximate the printhead and wherein the first portion is distant the printhead.

51. A recirculating inkjet printing method comprising:

storing ink at an ink supply having a constant internal volume;

flowing a first fluid, including the ink, from the ink supply to a reservoir;

flowing a second fluid, including the ink and air, from the reservoir to the constant internal volume of the ink supply; and adjusting a proportion of ink in the second fluid so as to maintain a predetermined ink level in the reservoir.

52. A recirculating inkjet printing system, comprising:

reservoir means for storing ink;

ink supply means for supplying ink to the reservoir means;

first fluid path means for flowing fluid, including ink, from the ink supply means to the reservoir means;

printing means for depositing a portion of the ink received from the reservoir means onto a medium;

second fluid path means for flowing fluid, including the ink and air, from the reservoir means to the ink supply means; and means for adjusting a proportion of the ink in the fluid carried from the reservoir means to the ink supply means to prevent overfilling the reservoir means, wherein the means for adjusting includes means for admitting air into the reservoir means and a porous media in the reservoir means, wherein the ink proportion adjusts relative to a degree of saturation of the porous media with ink.

* * * * *

UNITED STATES PATENT AND TRADEMARK OFFICE

CERTIFICATE OF CORRECTION

PATENT NO. : 7,040,745 B2
APPLICATION NO. : 10/285251
DATED : May 9, 2006
INVENTOR(S) : Blair M Kent It is certified that error appears in the above-identified patent and that said Letters Patent is hereby corrected as shown below:

In column 13, line 57, in Claim 13, delete “paint” and insert -- point --, therefor.

In column 13, line 62, in Claim 15, delete “claim 4” and insert -- claim 14 --, therefor.

In column 18, line 13, in Claim 49, after “location” insert -- along --.

Signed and Sealed this

Sixteenth Day of June, 2009

John Doll

JOHN DOLL
*Acting Director of the United States Patent and Trademark Office*